US006219497B1

(12) United States Patent
Hauman et al.

(10) Patent No.: US 6,219,497 B1
(45) Date of Patent: Apr. 17, 2001

(54) APPARATUS AND METHOD FOR REDUCING CONDENSATION IN AN IMAGE FORMING APPARATUS

(75) Inventors: Dewey H. Hauman, Penn Yan; Shyshung S. Hwang, Penfield; William M. Harney; Joseph S. Vetromile, both of Rochester; Susan M. Aurand, Fairport, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/447,557

(22) Filed: Nov. 23, 1999

(51) Int. Cl.[7] ..... G03G 15/00; G03G 21/20
(52) U.S. Cl. ..... 399/44; 399/92
(58) Field of Search ..... 399/44, 92, 94, 399/97, 91, 322, 407; 271/194, 197; 165/222, 244, 247

(56) References Cited

U.S. PATENT DOCUMENTS 3,770,346 * 11/1973 Jordan ..... 399/92
3,941,471 * 3/1976 Schatka et al. ..... 399/91
4,882,467 11/1989 Dimick ..... 219/219
5,453,824 * 9/1995 Vegeais ..... 399/92 X
5,500,658 3/1996 Hattori et al. ..... 347/22
5,530,523 * 6/1996 Kawabata ..... 399/44
5,657,636 8/1997 Suggs ..... 62/80
5,819,136 * 10/1998 Tomita et al. ..... 399/92 X

FOREIGN PATENT DOCUMENTS 57-006874 * 1/1982 (JP) .
58-062664 * 4/1983 (JP) .
60-239768 * 11/1985 (JP) .

* cited by examiner

*Primary Examiner*—Sophia S. Chen
(74) *Attorney, Agent, or Firm*—Oliff & Berridge, PLC

(57) ABSTRACT

A method of reducing condensation in an image forming apparatus wherein after the image forming apparatus is turned on and the fuser is being heated, a device is used to heat post Fuser paper path elements to reduce the possibility of condensation within the copier.

15 Claims, 4 Drawing Sheets

APPARATUS AND METHOD FOR REDUCING CONDENSATION IN AN IMAGE FORMING APPARATUS

BACKGROUND OF THE INVENTION

1. Field of Invention

This invention relates to apparatus and methods of reducing condensation in an image forming apparatus.

2. Description of Related Art

Various systems designed for transporting a copy sheet in a predetermined transfer path have a number of devices to advance and control movement of the sheet while it is advanced along the predetermined path within an image forming apparatus. Examples of such sheet control devices includes sheet grippers, baffles and sheet guides. Some of the sheet devices are fixed at various stationary locations adjacent a predetermined path. Consequently, the stationary sheet control devices act on the sheet as the sheet is transported past each stationary sheet control device. Some systems have multiple sheet control devices that move in and out of operative positions.

SUMMARY OF THE INVENTION

Copy sheet jamming often occurs near the upper turn of a post fuser portion of a transfer path due to moisture forming on the baffles and other sheet control devices of this portion of the transfer path. The moisture evaporates from the hot copy sheet as it passes through the fuser and along the post fuser transfer path. The hot moisture in the air then condenses on the surrounding cooler surfaces. Coated copy sheets, which are less able to absorb moisture and have smoother surfaces, have better contact with the condensed moisture on the baffles and can stall or generate contaminates in the transfer path. Ribs on the baffles have been added to reduce the contact area between the copy sheet and the baffles, which essentially minimizes the contact area and the chance of jamming of the copy sheet in the transfer path. Venting hot moist air near the fuser and along the transfer path will reduce the moisture condensation. Both venting holes for natural convection and ribs have been added to the baffles and tested. These two methods reduce the moisture condensation, but do not eliminate the jamming problems caused by moisture condensation.

One problem within the image forming apparatus is that the various temperatures of the individual components throughout the various regions of the image forming apparatus cause condensation to form within the image forming apparatus and on its various components. Condensation causes many problems within the image forming apparatus and to the copy sheets. First, condensing water on the individual components of the image forming apparatus can damage the parts. Second, the water that condenses on the members and copy sheets causes jams within the image forming apparatus. The condensation causes the copy sheets to stick to surfaces of the image forming apparatus and to other copy sheets within the printing apparatus. Additionally, when condensation forms on transfer guides and the transfer guides come in contact with a copy sheet, the drag coefficient rises dramatically, and can be up to five times higher than without condensation. The combination of condensation and the high drag causes sheet skew and/or sheet stall in the transfer path.

Conventionally, as described above, this condensation problem has been attacked by creating slots within the paper guide. However, this has not completely disposed of the condensation which has formed and has also caused the corners of the leading edge of the copy sheet to jam within the slots.

This invention provides systems and methods that reduce condensation and paper jamming that occurs within an image forming apparatus.

In various exemplary embodiments of the systems and methods of this invention, the critical baffle areas, such as the gate and others where the moist air can not be easily vented, are heated to reduce the moisture condensation at those particular areas The temperatures of the copy sheets and baffles, the moisture evaporating from the copy sheets, and the moisture condensating from moist air to cold baffles along the post fuser transfer path have been considered by the inventors. At high copy sheet temperatures, for example, at the temperature of the copy sheets right after they leave the fuser, the copy sheets have a high rate of moisture evaporation. The rate of moisture evaporation decreases with time as the copy sheets move through the image forming apparatus. Different types of copy sheets, such as different types of paper, possess different moisture diffusion coefficients. The moisture diffusion coefficients and the temperature of the paper together control the amount and rate of moisture evaporation. The moisture condensation from moist air onto cooler surfaces depends on the moisture content in the air and the temperature of the surrounding cooler surfaces. The inventors have determined that the location and conditions of moisture condensation can be predicted. The moisture condensation is likely to occur shortly downstream of a high temperature region, such as after the fuser area, because of high moisture evaporation from the copy sheet.

In one exemplary embodiment of an image forming apparatus that can beneficially incorporate this invention, after an electrostatic latent image is recorded on a photoconductive member, the latent image is developed by bringing a developer material into contact with the photoconductive member. The toner particles are attracted to the latent image to form a developed image on the photoconductive member.

This developed image is subsequently transferred to a copy sheet. The copy sheet is then heated to permanently affix the toner particles of the developed image to the sheet. After exiting the fuser portion of the image forming apparatus, the copy sheet is relatively warm. The developed copy sheet is then received by a baffle that is much colder. This change in temperature between the warm copy sheet and the cold baffle causes high relative humidity and promotes the formation of water droplets formed from condensation. The condensation that is created occurs when the fuser heats the copy sheet and the moisture that develops from the copy sheet evaporates over time in the transfer guides and other components of the transfer path that follow the fuser portion. Thus, the relative humidity of the air between the transfer guides increases. Eventually, the dew point is reached in this area and condensation forms on the surface of the transfer guides and other various components of the transfer path.

This invention provides systems and methods for reducing condensation by drawing ambient heated air into the vacuum transport.

This invention separately provides an image forming apparatus that is less susceptible to humidity-related faults.

This invention separately provides an image forming apparatus in which condensation is less likely to form.

This invention separately provides an image forming apparatus that has improved air flow and/or humidity control in baffled and vacuum transport areas. In the systems and methods according to this invention, the blower motor of an image forming apparatus is turned on when an image forming apparatus is turned on.

These and other features and advantages of the systems and methods of this invention are described in or are apparent from the following detailed description of the various exemplary embodiments.

BRIEF DESCRIPTION OF THE DRAWINGS

This invention will be described in relation to the following drawings in which reference numerals refer to like elements, and wherein.

DETAILED DESCRIPTION OF PREFERRED EMBODIMENTS

Figure 1:
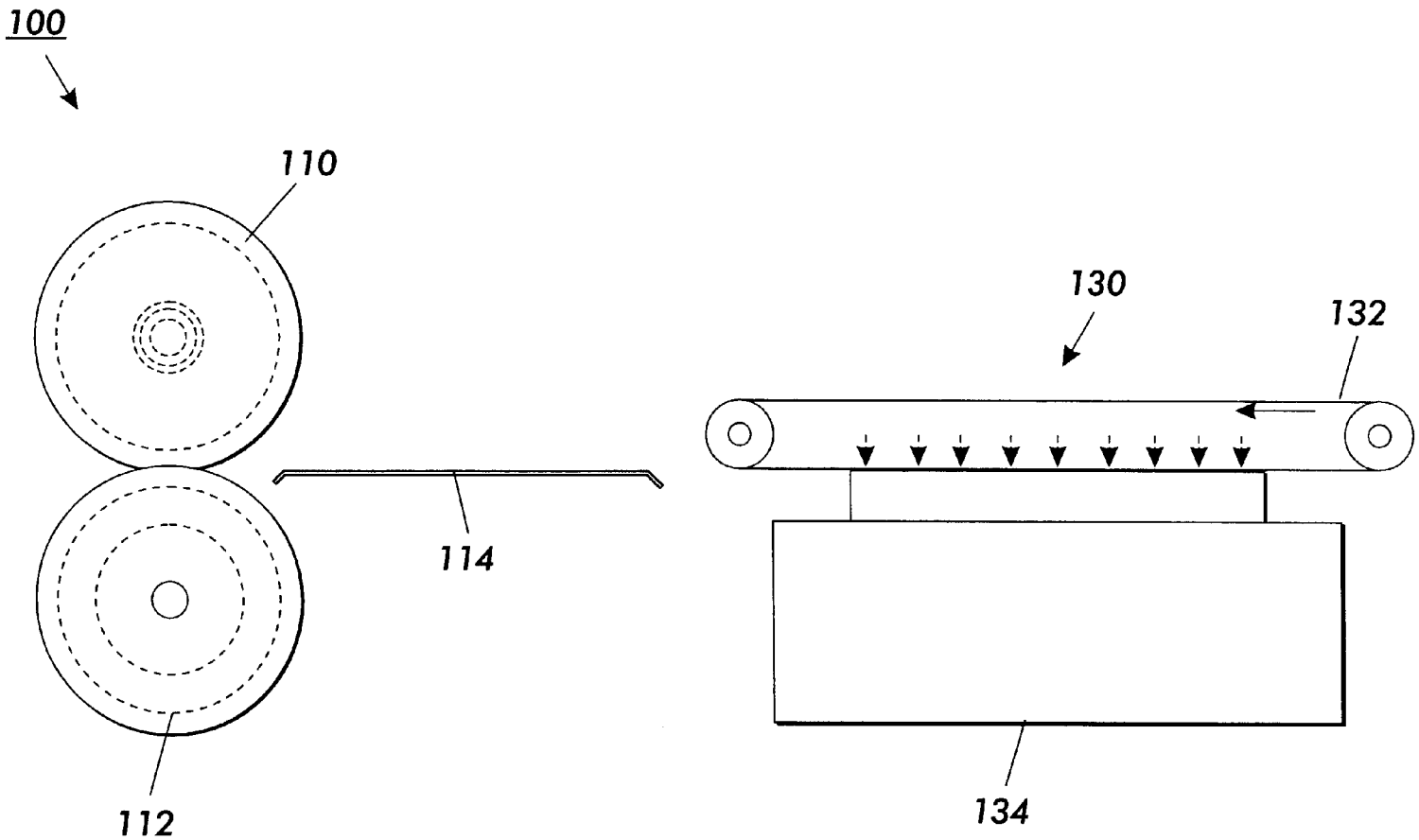
FIG. 1 is a block diagram side view of one exemplary embodiment of the fuser and vacuum transport in an image forming apparatus according to this invention.

FIG. 1 shows a block diagram side view of one exemplary embodiment of the fuser and vacuum transport region 100 in an image forming apparatus according to this invention. As shown in FIG. 1, the fuser and vacuum transfer region 100 includes a fuser roll 110, a pressure roll 112, a baffle 114 and a vacuum transport 130. The vacuum transport 130 includes a vacuum transfer belt 132 and a vacuum blower 134.

In operation, a copy sheet, or more generally, an image recording medium, passes between the fuser roll 110 and the pressure roll 112 and is received by the finger baffle 114. The finger baffle 114 transfers the image recording medium, such as, for example, a sheet of paper, to the vacuum belt 132 of the vacuum transport 130. The image recording medium is drawn to the vacuum belt 132 by the vacuum blower 134 so that the image recording medium does not skew as it is transferred by the vacuum transport 130. Thus, it should be appreciated that the fuser and vacuum transport region 100 shown in FIG. 1 includes a post fuser portion of the transfer path of the image forming apparatus.

Referring to FIG. 1, the vacuum transport 130 is generally used to transfer the recording medium from one location in the image forming apparatus to another location. In order to reduce the build up of condensation on the post fuser vacuum transport 130, various exemplary embodiments of the systems and methods according to this invention include an air circulation device that is activated during machine warm-up. The air circulation device may be a fan, a vacuum, a blower or any other known or later developed device able to create a flow of air. In one exemplary embodiment, the transport vacuum 130 is used as the air circulation device. In this exemplary embodiment, the transport vacuum 130 is run during machine warm-up so that the warm air surrounding the fuser roll 110 circulates and warms the surfaces of the fuser and vacuum transport region 100 and reduces the likelihood of condensation within the fuser and vacuum transport region 100. Conventionally, the vacuum transport 130 is generally not operated until the image forming apparatus begins to perform an image forming operation. However, the inventors have discovered that, when the image forming apparatus is initially turned on, a significant amount of condensation forms in the fuser and vacuum transport region 100 during this period. This condensation is due to the fuser roll 110 being heated to a high temperature while all the surrounding components are kept at or near ambient temperature. The significant change in temperature between the fuser and vacuum transport region 100 and the fuser roll 110 creates a high dew point. By running the vacuum transport 130 during start-up, the dew point is lowered. The resulting lower dew point greatly reduces any condensation potential within the fuser and vacuum transport region 100.

Various exemplary embodiments of the systems and methods according to this invention are able to reduce condensation by performing a plurality of procedures which may be performed in any order. Initially, a user turns on the image forming apparatus or causes the image forming apparatus to switch from a suspend mode to an active mode. When the image forming apparatus is turned on or is initially warming up after being switched from the suspend mode to the active mode, the fuser 110 is activated and the fluser roll 110 begins to heat up. Usually, it takes the image forming apparatus up to about 10 minutes to heat the fuser roll 110 to a temperature where the image forming apparatus is capable of performing image forming operations. In various exemplary embodiments, at about the same time that the time the image forming apparatus and the fuser roll 110 are turned on, the vacuum transport 130 is activated so that vacuum blower 134 within the vacuum transport 130 circulates the air within at least the fuser and vacuum transport region 100 of the image forming apparatus.

Because the fuser roll 110 is heated to a high temperature while the surrounding components within at least the fuser and vacuum transport region 100 of the image forming apparatus remain at or near ambient temperature, a significant difference in temperature within the image forming apparatus occurs. However, by turning on the vacuum blower 134, the warmer temperature air surrounding the fuser roll 110 is drawn toward and circulated by the vacuum transport 130. This causes the warmer air to circulate in at least the fuser and vacuum transport region 100, thus warming the surfaces of the vacuum transport 130 and surrounding areas of at least the fuser and vacuum transport region 100. Once the fuser roll 110 has been heated to the desired temperature and the image forming apparatus is in a condition to perform image forming operations, the vacuum blower 134 may be turned off until the image forming apparatus is required to perform an image forming operation.

However, it should be appreciated that the vacuum blower 134 may be left on continuously while the image forming apparatus is turned on. In various exemplary embodiments of the systems and methods described herein, the vacuum transport 130 has two primary functions. The first function of the vacuum blower 134 is to circulate air when the image forming apparatus is turned on or placed into the activated mode to decrease the dew point within the image forming apparatus and to reduce condensation. The second function is to hold the image recording medium down along the vacuum transport 130 during transfer of the image recording medium from the fuser roll 110 along the post fuser transfer path.

Figure 2:
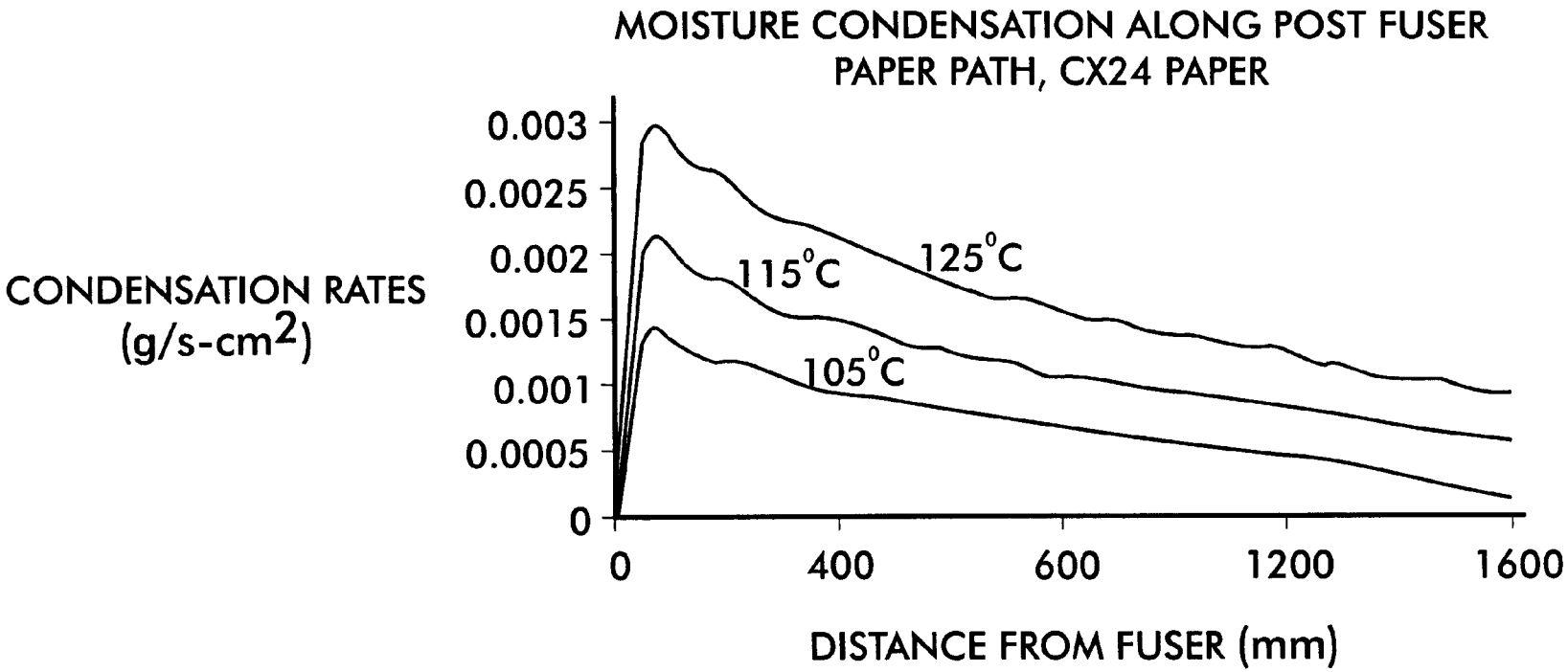
FIG. 2 is a graph showing the moisture condensation along the post fuser transfer path for a Color Expressions 24# paper.

FIG. 2 graphically illustrates the moisture condensation rates for moisture evaporation from CX24 paper on the baffles 114 along the post fuser transfer path shown in FIG. 1 with an active ambient volume of 1,500 $cm^3$. The graph shown in FIG. 2 illustrates the moisture condensation of CX24 paper exiting the fuser roll 110 at temperatures of 105°, 115° and 125° Celsius. The room ambient conditions include an ambient air temperature of 72° F. and a relative humidity of 37%. Immediately downstream of the fuser roll 110, the condensation rate is high because of more moisture evaporation in that region. Downstream of this high condensation area, the condensation rate starts to decrease because less moisture is available from evaporation of moisture from the CX24 paper. The temperatures of the baffle 114, the ambient room temperature, and the active ambient volume are the important parameters for the moisture condensation.

Figure 3:
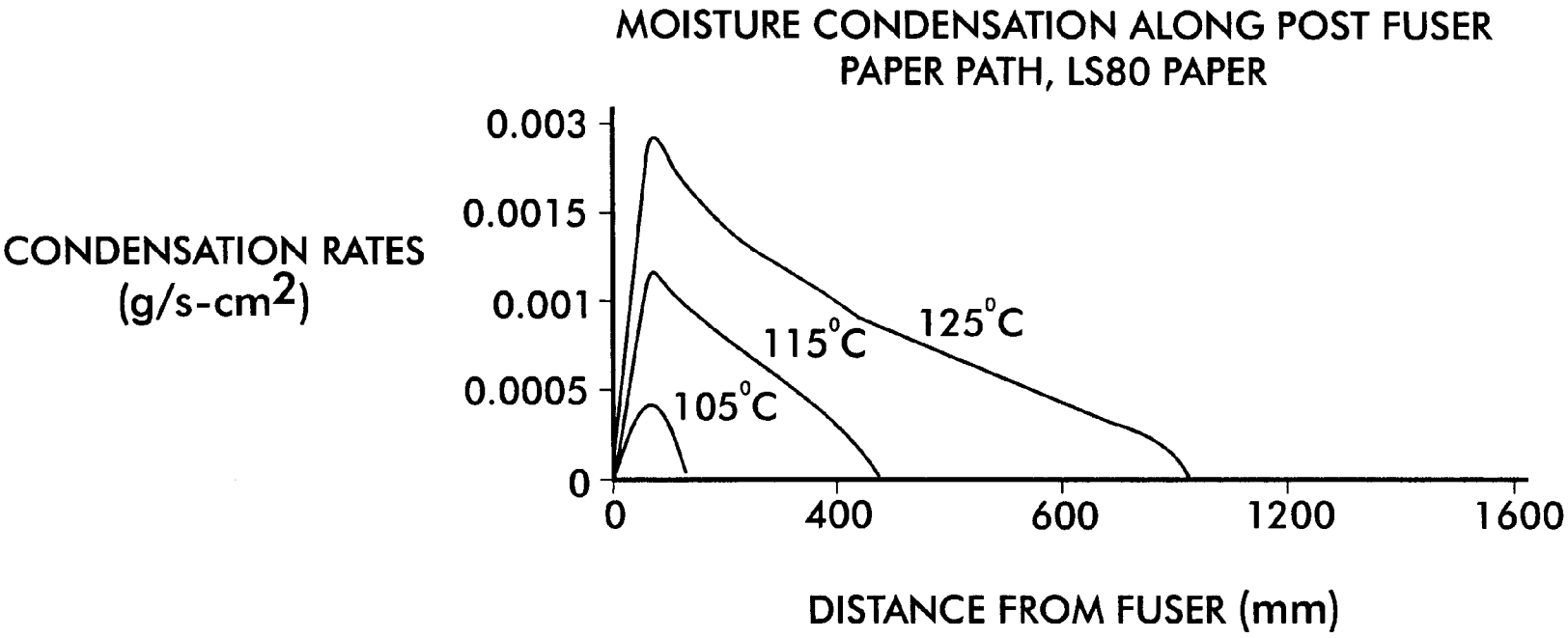
FIG. 3 is a graph showing the moisture condensation along the post fuser transfer path for a Lustrogloss B80 paper.

FIG. 3 graphically illustrates moisture condensation rates for moisture evaporation from LS80 coated paper along the post fuser transfer path shown in FIG. 1. The active ambient volume and ambient conditions are the same as for the case of CX24 plain paper. The moisture condensation rate for the LS80 coated paper is lower than the moisture condensation rate for the CX24 paper. If the copy sheet exits the fuser roll 110 at a lower temperature of 105°C., the moisture condensation on the baffle will not occur in most of the paper path. And, if the active ambient volume is increased to 6,200 $cm^3$, the moisture doesn't condense on the baffle for all three temperatures, i.e., for a copy sheet exiting the fuser at temperatures of 125°, 115°, and 105° C. For the 6 cases shown in FIGS. 2 and 3, the peak condensation occurs at locations not too far away from the fuser. These peak condensation locations will change if the conditions are different.

Figure 4:
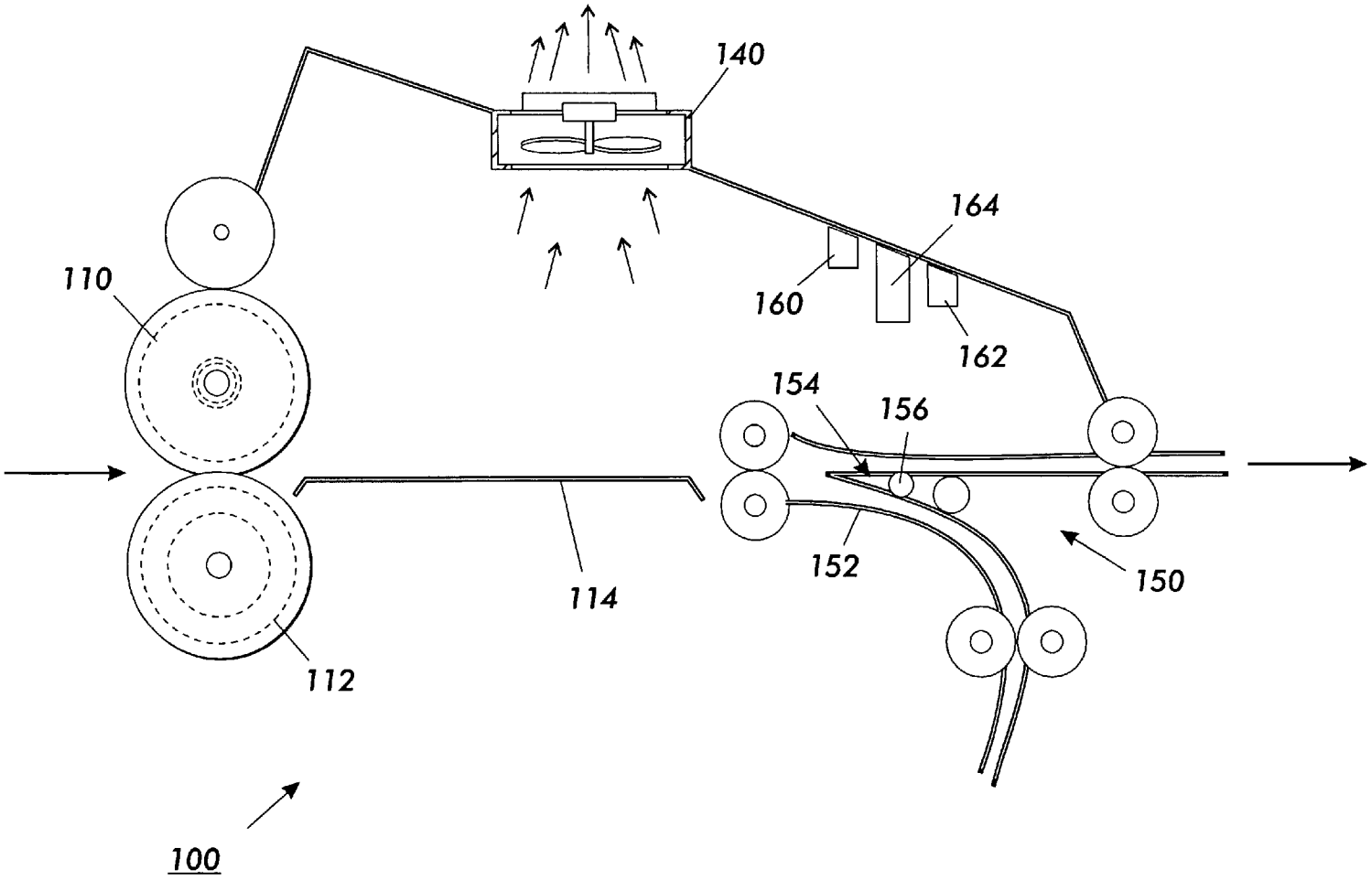
FIG. 4 is a side view of post fuser transfer path.

Venting the moist air can be improved by using forced convention instead of just natural convection. As shown in FIG. 4, a small suction fan 140 near the post fuser transfer path should be sufficient to direct the air flow opposite to the transfer direction so that hot moist air does not flow into the cooler downstream section. The amount of air flow should be selected so that the fuser roll 110 is not overcooled and to avoid disturbing the flow or motion of the copy sheet.

That is, there are some areas along the transfer path where the air should not be forced to flow. For these difficult areas, moisture condensation is avoided by raising the surface temperatures of elements in those areas. For example, one such area includes a transfer path gate area 150 where there is more than one possible path for the copy sheet to take. Adding an additional air flow in this gate area 150 may cause the copy sheet to take the wrong path.

The gate area 150 includes a baffle 152 that defines a space 154. A heating element 156 is placed in the space 154. The heating element 156 heats the baffle 152 so that the temperature of the baffle 152 is generally above the saturation temperature. With this approach, the moisture will not condense at these critical locations. This local heating can be accomplished by many different ways. The easiest way is by attaching the heating elements 156 to the baffles 152 or to components at the critical areas or mounting heating lamps at a close proximity.

FIG. 4 shows the arrangement of this suction fan 140 and the critical heated gate area 150 along the post fuser paper path. The gate area 150 can be heated with a flexible heater, cartridge heater, or a rope heater. The other such critical areas of image forming apparatus can easily be heated with flexible heaters.

The heating element 156 is connected to a temperature controller 164 so that the power can be turned off when the heating element 156 reaches a certain temperature. A simple on-off thermostat can act as the controller 164. The set temperature of the controller 164 is determined by the saturation temperature, which itself is a function of the ambient temperature and the relative humidity. In one exemplary embodiment, a first sensor 160 is used to measure the ambient temperature and a second sensor 162 is used to measure the relative humidity. Once the ambient temperature and relative humidity are known, a look-up table can be used to determine the saturation temperature. The set temperature should be slightly higher than the saturation temperature. In an exemplary embodiment, pairs of the sensors 160 and 162 are located near the critical areas throughout the image forming apparatus.

It should also be appreciated that, in addition to, or instead of, controlling the heating element 156, the controller 164 can be used to control either or both of the fan 140 and/or the vacuum transport 130. Thus, the controller 164 can be used, for example, to control when the vacuum transport 130 is turned on, in addition to, or in place of, the times/events described above during which the vacuum transport 130 is turned on.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A method for reducing condensation within an image forming apparatus, comprising:

placing the image forming apparatus in an activated state where the image forming apparatus is ready to form an image on a recording medium;

activating at least one heated member to raise a temperature of the heated member; and activating an air circulation device approximately at the same time the at least one heated member is activated, wherein:

the air is circulated in a region around the at least one heated member such that condensation within the image forming apparatus is reduced.

2. The method of claim 1, wherein the at least one heated member is heated above an ambient temperature of the image forming apparatus.

3. A method for reducing condensation with an image forming apparatus, comprising:

placing the image forming aratus in an activated state where the image forming apparatus is ready to form an image on a recording medium;

activating at least one heated member to raise a temperature of the heated member; and activating an air circulation device approximately at the same time the at least one heated member is activated;

wherein the air is circulated in a region around the at least one heated member, and after a temperature of at least one of the at least one heated member reaches a corresponding desired temperature, the air circulation device is turned off until the image forming apparatus receives an instruction to perform an image forming operation.

4. A method for reducing condensation within an image forming apparatus, comprising:

placing the image forming apparatus in an activated state where the image forming apparatus is ready to form an image on a recording medium;

activating at least one heated member to raise a temperature of the heated member; and activating an air circulation device approximately at the same time the at least one heated member is activated; wherein the air is circulated in a region around the at least one heated member, and circulating the air in the region around the at least one heated member warms at least one element of the image forming apparatus located in the region around at least one of the at least one heated member.

5. An image forming apparatus having an air circulation device and an anti-condensation unit that is located near at least one critical area within the image forming apparatus, the anti-condensation unit comprising:

a first sensor which measures an ambient temperature in a region near the at least one critical area;

a second sensor which measures a humidity in a region near the at least one critical area; and a temperature controller that communicates with the first and second sensors and activates the air circulation device based on signals from the first and second sensors.

6. The anti-condensation unit as claimed in claim 5, wherein the temperature controller is a thermostat.

7. The anti-condensation unit as claimed in claim 5, wherein the air circulation device is at least one of a fan and a vacuum transport.

8. The anti-condensation unit as claimed in claim 5, further includes a heating member, the temperature controller activating the heating member based on signals from the first and second sensors.

9. The anti-condensation unit as claimed in claim 8, wherein the heating member is located near a baffle member.

10. The anti-condensation unit as claimed in claim 8, wherein the heating member is at least one of a flexible heater, a cartridge heater, and a roper heater.

11. An anti-condensation unit located near at least one critical area within an image forming apparatus, wherein the anti-condensation unit comprises:

first sensing means for measuring humidity in a region near the at least one critical area;

second sensing means for measuring ambient temperature in the region near the at least one critical area;

temperature control means, for controlling at least one anti-condensation means communicating with the first and second sensors controlling at least one anti-condensation means;

the anti-condensation means comprises air circulation means for circulating air within the image forming apparatus.

12. The anti-condensation unit as claimed in claim 11, wherein the air circulation means is at least one of a fan and a vacuum transport.

13. The anti-condensation unit as claimed in claim 11, wherein the anti-condensation means comprises heating means for heating at least a portion of the image forming apparatus.

14. The anti-condensation unit as claimed in claim 11, wherein further including a heating means located near a baffle member.

15. The anti-condensation unit as claimed in claim 14, wherein the heating means is at least one of a flexible heater, a cartridge heater, and a roper heater.

* * * * *